US012196209B2

(12) United States Patent
Koester et al.

(10) Patent No.: US 12,196,209 B2
(45) Date of Patent: Jan. 14, 2025

(54) MULTIPATH PASSIVE DISCHARGE VALVE FOR A COMPRESSOR

(71) Applicant: Hanon Systems, Daejeon (KR)

(72) Inventors: Steven J. Koester, Sylvania, OH (US); Brad Crenshaw, Riverview, MI (US)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 18/608,131

(22) Filed: Mar. 18, 2024

(65) Prior Publication Data

US 2024/0418171 A1 Dec. 19, 2024

Related U.S. Application Data

(60) Provisional application No. 63/508,227, filed on Jun. 14, 2023.

(51) Int. Cl.

| | |
|---|---|
| ***F04C 28/24*** | (2006.01) |
| ***F04C 29/12*** | (2006.01) |
| *F04C 18/02* | (2006.01) |

(52) U.S. Cl.

CPC ..... *F04C 29/126* (2013.01); *F04C 28/24* (2013.01); *F04C 18/0215* (2013.01)

(58) Field of Classification Search

CPC ..... F16K 15/00; F16K 47/08; F15C 1/146; F04C 28/24; F04C 29/126

See application file for complete search history.

(56) References Cited

U.S. PATENT DOCUMENTS

| | | | | |
|---|---|---|---|---|
| 1,329,559 | A | 2/1920 | Tesla | |
| 4,631,553 | A | 12/1986 | Sekiya | |
| 5,265,636 | A * | 11/1993 | Reed | F15C 1/146 137/833 |
| 5,876,187 | A | 3/1999 | Afromowitz et al. | |
| 7,108,494 | B2 * | 9/2006 | Nam | F04C 29/126 137/533.17 |
| 7,934,915 | B2 | 5/2011 | Sun | |

(Continued)

FOREIGN PATENT DOCUMENTS

| | | | |
|---|---|---|---|
| CN | 114076101 | A | 2/2022 |
| EP | 4095381 | A1 | 11/2022 |

(Continued)

*Primary Examiner* — Deming Wan

(74) *Attorney, Agent, or Firm* — James D. Miller; Shumaker, Loop & Kendrick, LLP

(57) ABSTRACT

A passive discharge valve for a scroll compressor and method of use are disclosed. The passive discharge valve is configured to control a flow of fluid from a compression mechanism into a discharge chamber formed in a housing of the scroll compressor. The passive discharge valve comprises a main body including a common central aperture and one or more valvular conduits formed therein. The valvular conduits extend radially outwardly from the common central aperture and each has an inlet aperture in fluid communication with a discharge port of the compression mechanism and an outlet aperture in fluid communication with the discharge chamber. Each of the valvular conduits comprises a first flow path and a second flow path, wherein the second flow path intermittently intersects the first flow path to create a fluidic diode, which militates against reverse fluid flow (or backflow) during operation of the scroll compressor.

20 Claims, 10 Drawing Sheets

(56) References Cited

U.S. PATENT DOCUMENTS

| | | | | |
|---|---|---|---|---|
| 9,915,362 | B2 * | 3/2018 | Hampton | F16K 99/0057 |
| 11,047,249 | B2 * | 6/2021 | Schwendenmann | F16J 15/4476 |

FOREIGN PATENT DOCUMENTS

| | | | |
|---|---|---|---|
| JP | 2010-077847 | A | 4/2010 |
| KR | 10-2258253 | B1 | 5/2021 |

* cited by examiner

MULTIPATH PASSIVE DISCHARGE VALVE FOR A COMPRESSOR

CROSS-REFERENCE TO RELATED APPLICATION

This application claims the benefit of U.S. Provisional Patent Application Ser. No. 63/508,227, filed Jun. 14, 2023, the entirety of which is herein incorporated by reference.

FIELD

The disclosure relates to a compressor, and more particularly to a multipath passive discharge valve for a compressor.

BACKGROUND

As is commonly known, vehicles typically include a heating, ventilating, and air conditioning (HVAC) system. In certain applications, a scroll compressor is employed for compressing a refrigerant circulated through a refrigerant circuit of the HVAC system.

Generally, scroll compressors include a fixed scroll that remains stationary and an orbiting scroll that is nested relative to the fixed scroll and configured to orbit relative to the fixed scroll. The orbiting motion of the orbiting scroll, as well as the similar spiral shape of each of the fixed scroll and the orbiting scroll, continuously forms corresponding pairs of substantially symmetric compression chambers between the fixed scroll and the orbiting scroll. Each pair of the compression chambers is typically symmetric about a centralized discharge port of the scroll compressor. Refrigerant typically enters each of the compression chambers via one or more inlet ports formed adjacent a radially outmost portion of the fixed scroll and then the orbiting motion of the orbiting scroll relative to the fixed scroll results in each of the compression chambers progressively decreasing in volume such that the refrigerant disposed within each of the compression chambers progressively increases in pressure as the refrigerant approaches the radially central discharge port.

Typically, scroll compressors use a flow control mechanism, located adjacent to the radially central discharge port, to reduce backflow during refrigerant compression. One such flow control mechanism is a reed valve. A reed valve is a flapper style valve, typically provided as a flexible metallic reed, where the pressure applied to the end of the valve controls the opening and closing of the valve. However, reed style discharge valves are traditionally provided to include repeated metal to metal contact, which greatly reduces the durability of such reed valves. Current reed style discharge valves are prone to failure at high cycles in fixed scroll compressors with a long use span.

It would therefore be desirable to produce a multipath passive discharge valve assembly for a scroll compressor that uses only fluid pathing to reduce backflow and pressure pulsation during operation.

SUMMARY

In concordance and agreement with the present disclosure, a multipath passive discharge valve for a scroll compressor that uses only fluid pathing to reduce reverse flow and pressure pulsation during operation, eliminating the need for reed valves, which contain a potential point of failure due the mechanical wear that moving parts can suffer, has surprisingly been designed.

A solution to the lack of durability of current reed style discharge valves comes in the form of a passive flow control mechanism, which eliminates the possibility that mechanical wear will cause the flow control mechanism to fail due to the lack of moving components. Embodiments of present disclosure utilize a method of fluid flow control that takes advantage of a Tesla valvular conduit. More particularly, the embodiments are directed to a passive flow control mechanism or valve that utilizes enlargements, recesses, and protrusions in a certain pattern that generates a self-intersecting flow path to create fluidic diodes and restrict a direction of a flow of a fluid.

The valve of the present disclosure utilizes the enlargements, recesses, and projections to control the passage of fluids in a manner that offers virtually no resistance to the passage of fluids in one direction while providing a nearly impassable barrier to fluid flow in the opposite direction. In some embodiments, the passive fluid control mechanism is a valve with a radial array of fluid pathing that is able to replace the conventional reed valve while maintaining similar flow control and compressor performance, and while eliminating a potential compressor point of failure due to reed valve mechanical wear.

In one embodiment, a passive discharge valve for a scroll compressor, comprises: at least one valvular conduit having an inlet aperture in fluid communication with a compression mechanism of the scroll compressor and an outlet aperture in fluid communication with a discharge chamber of the scroll compressor, wherein the at least one valvular conduit comprises a first flow path and a second flow path, wherein the second flow path intermittently intersects the first flow path to create at least one fluidic diode in the at least one valvular conduit.

In another embodiment, a method for controlling fluid flow in a scroll compressor, comprises: providing a passive discharge valve in fluid communication with a compression mechanism of the scroll compressor and a discharge chamber of the scroll compressor, wherein the passive discharge valve comprises: at least one valvular conduit including a first flow path and a second flow path, wherein the second flow path intermittently intersects the first flow path to create at least one fluidic diode in the at least one valvular conduit to militate against a flow of a fluid from the discharge chamber to the compression mechanism.

As aspects of some embodiments, the inlet aperture is in fluid communication with a discharge port of the compression mechanism.

As aspects of some embodiments, the first flow path comprises a plurality of linear segments.

As aspects of some embodiments, the second flow path comprises a plurality of arcuate shaped second segments.

As aspects of some embodiments, the first flow path is configured to permit a flow of a fluid from the compression mechanism to the discharge chamber in a first direction.

As aspects of some embodiments, the second flow path is configured to militate against a flow of the fluid from the discharge chamber to the compression mechanism in an opposite second direction.

As aspects of some embodiments, the at least one fluidic diode militates against a flow of a fluid from the discharge chamber to the compression mechanism.

As aspects of some embodiments, the second flow path intersects the first flow path at an angle in a range of about 0 degrees to about 180 degrees.

As aspects of some embodiments, the second flow path intersects the first flow path at an angle of about 90 degrees.

As aspects of some embodiments, at least one of the inlet aperture, the outlet aperture, and a portion of the at least one valvular conduit between the inlet and outlet apertures has a generally rectangular cross-sectional shape.

As aspects of some embodiments, the passive discharge valve is a separate component coupled to at least one of the compression mechanism and a housing of the scroll compressor.

As aspects of some embodiments, the at least one valvular conduit is formed in a main body of the passive discharge valve.

As aspects of some embodiments, the passive discharge valve is integrally formed with at least one of the compression mechanism and a housing of the scroll compressor.

As aspects of some embodiments, the at least one valvular conduit is formed in at least one of a fixed scroll of the compression mechanism and a rear head of the scroll compressor.

As aspects of some embodiments, the at least one valvular conduit is formed by a plurality of protrusions defining a U-shaped profile.

As aspects of some embodiments, at least one gap is formed between the protrusions to define at least one of the first flow path and the second flow path.

As aspects of some embodiments, the at least one valvular conduit extends radially outwardly from a common central location of the passive discharge valve.

As aspects of some embodiments, the passive discharge valve further comprises a flow feature configured to direct a flow of a fluid from the compression mechanism into the at least one valvular conduit.

As aspects of some embodiments, the flow feature has a generally curved cone shape.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 10:
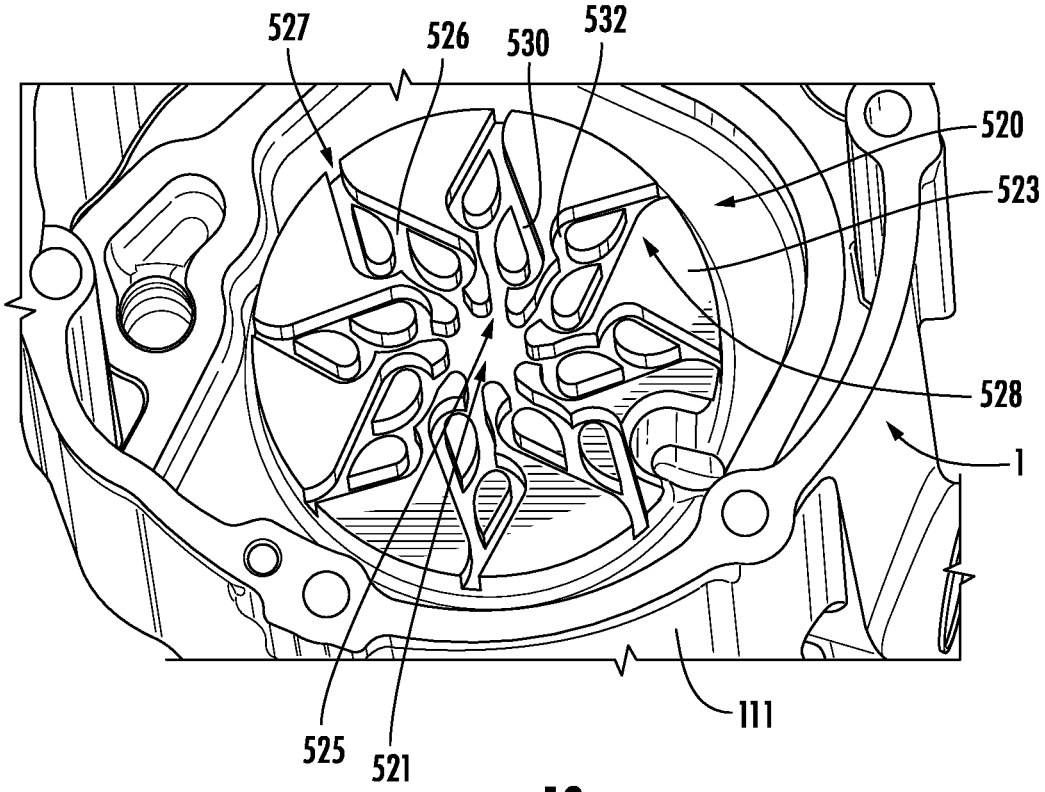
Figure 11:
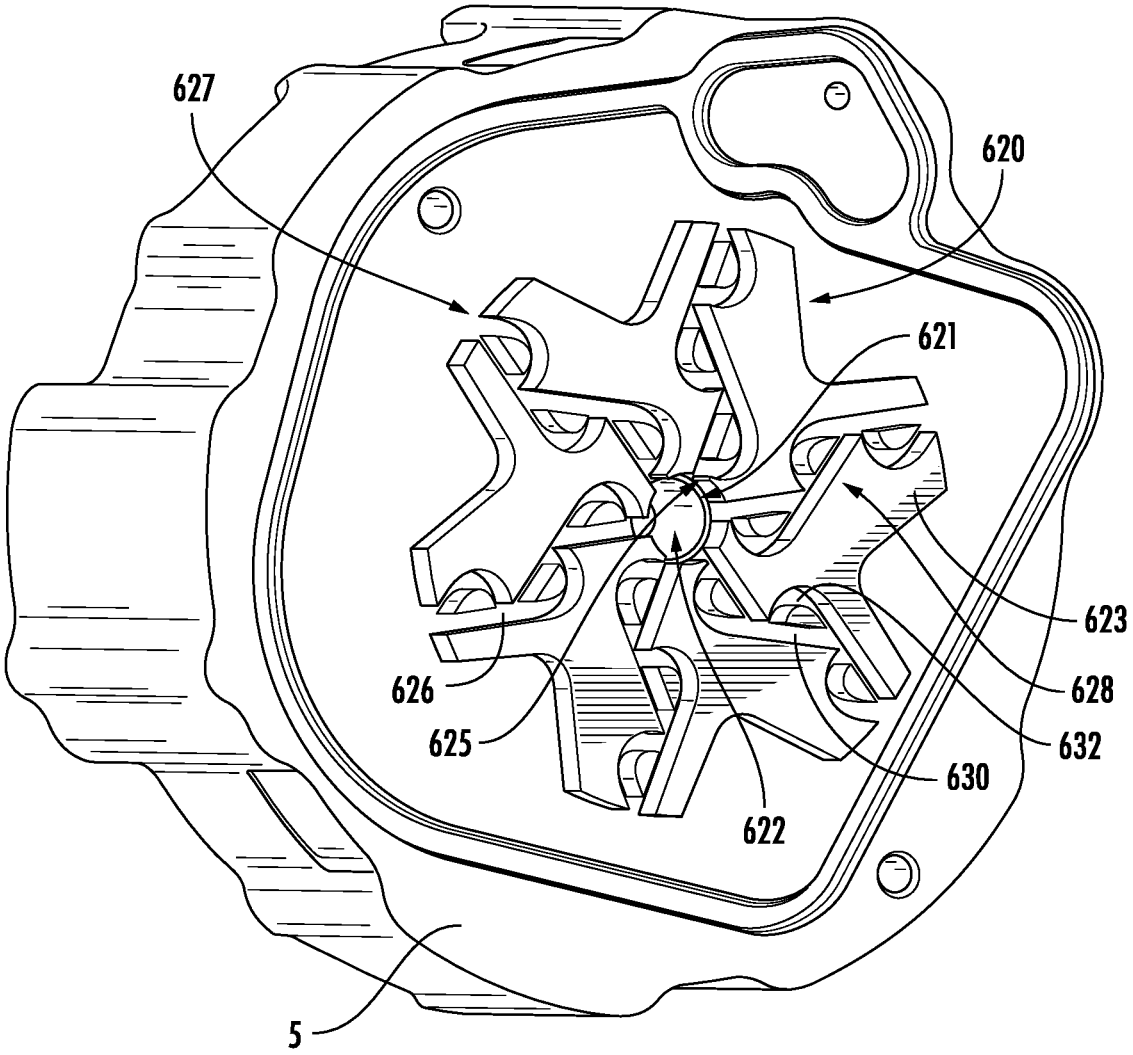

FIG. 10 is a perspective front end view of a portion of a scroll compressor according to yet another embodiment of the present disclosure, wherein a passive discharge valve is integrally formed in a rear head of the scroll compressor; and FIG. 11 is a perspective rear end view of a portion of a scroll compressor according to yet another embodiment of the present disclosure, wherein a passive discharge valve is integrally formed in the fixed scroll of the scroll compressor and a cover of the passive discharge valve is not depicted.

DETAILED DESCRIPTION

The following description of technology is merely exemplary in nature of the subject matter, manufacture and use of one or more disclosures, and is not intended to limit the scope, application, or uses of any specific disclosure claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
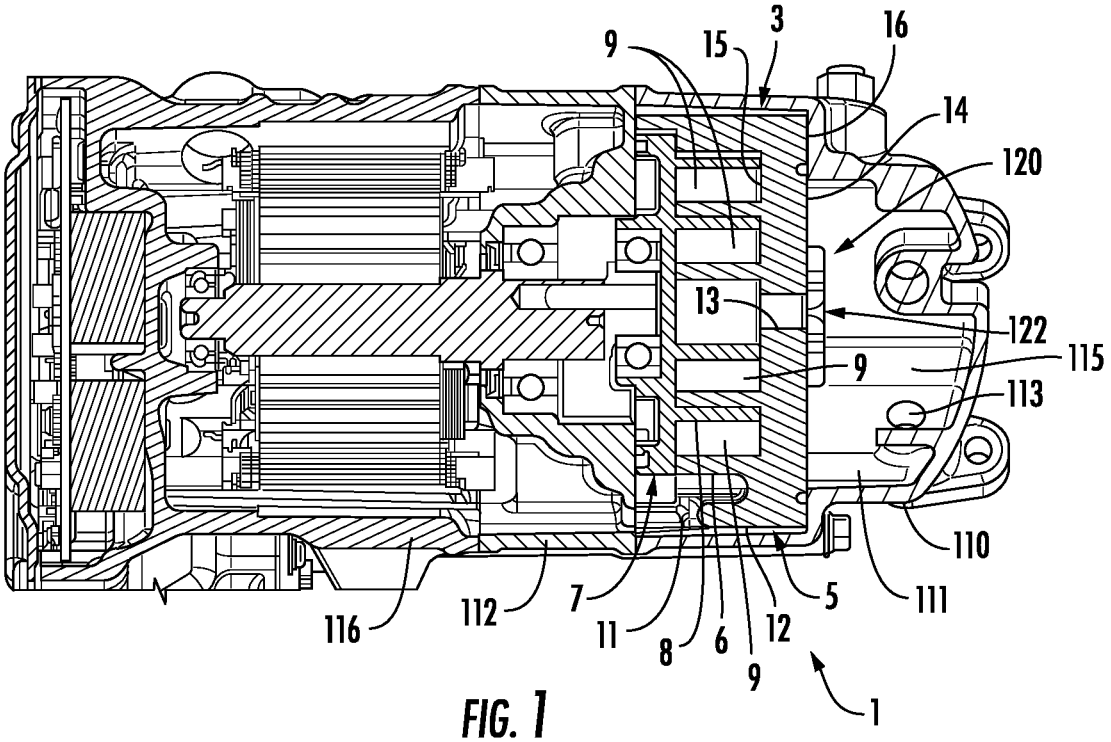
FIG. 1 is a cross-sectional view of a scroll compressor according to an embodiment of the present disclosure.

FIG. 1 illustrates a scroll compressor 1 having a passive discharge valve 20 according to an embodiment of the present disclosure. The scroll compressor 1 may be provided as a component of an HVAC system of a motor vehicle, and more particularly, a component for circulating a fluid (e.g., a refrigerant, coolant, etc.) of an associated fluid circuit in thermal energy exchange communication with air to be delivered to the passenger compartment of the associated motor vehicle. The fluid may also be in thermal energy exchange relationship with additional components of the motor vehicle in need of heat and temperature regulation, such as a battery or other electronic components associated with operation of various different systems of the motor vehicle. References to the fluid as used hereinafter may refer to a fluid when provided solely as a gas or as a mixture of a gas and a liquid. Although the scroll compressor 1 is described as being utilized for a fluid of an HVAC system, it should be apparent that the structure disclosed herein may be adapted for use with any fluid in need of compression with respect to any associated fluid system, as desired.

Figure 3:
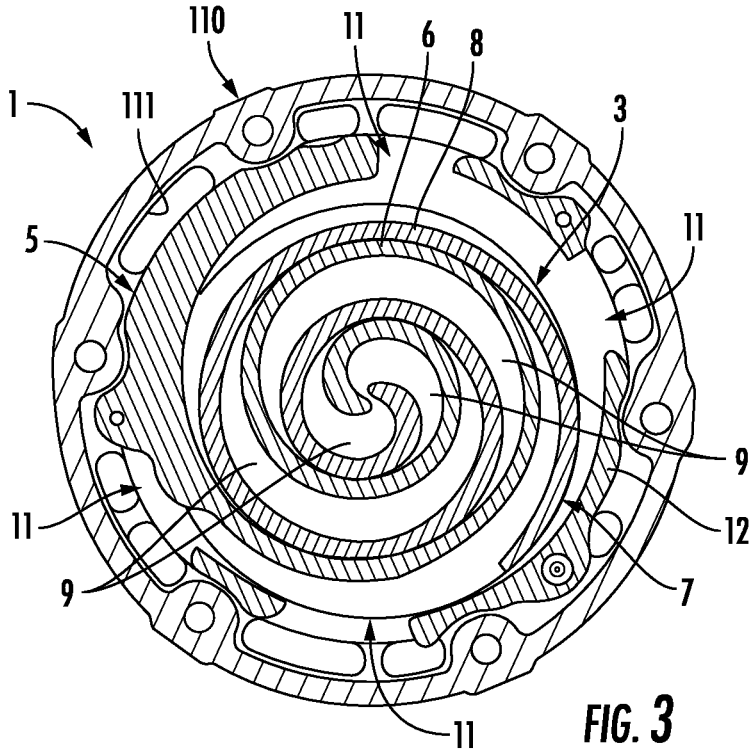
FIG. 3 is a cross-sectional elevational view taken through a compression mechanism of the scroll compressor.

As shown, the scroll compressor 1 includes a compression mechanism 3 formed by a fixed scroll 5 and an orbiting scroll 7. As best seen in FIG. 3, the fixed scroll 5 has an axially extending first spiral structure 6 and the orbiting scroll 7 has an axially extending second spiral structure 8. The second spiral structure 8 extends in an opposing axial direction relative to the first spiral structure 6 with each of the spirals of the second spiral structure 8 nested into each of the spaces formed between adjacent spirals of the first spiral structure 6. The first spiral structure 6 and the second spiral structure 8 are positioned relative to each other to form a plurality of compression chambers 9 therebetween during operation of the compression mechanism 3 of the scroll compressor 1.

The fixed scroll 5 includes at least one inlet opening 11 adjacent a radially outermost portion thereof for introducing the fluid into each of the compression chambers 9. In the provided embodiment, the fixed scroll 5 includes a plurality of the inlet openings 11 circumferentially spaced apart from each other in an outer circumferential wall 12 of the fixed scroll 5 with each of the inlet openings 11 provided as a hole, indentation, or other form of passageway allowing for radially inward flow of the fluid into one of the compression chambers 9. The fluid generally enters the fixed scroll 5 through one of the inlet openings 11 at a relatively low pressure commonly referred to as a suction pressure of the scroll compressor 1. The fixed scroll 5 further includes a radially central discharge port 13 formed at a radial innermost end of the first spiral structure 6 through which the fluid exits each of the compression chambers 9 after having been compressed therein. The radially central discharge port 13 is accordingly located at or adjacent a radial center of the fixed scroll 5. The compressed fluid thereby exits the cooperating scrolls 5, 7 of the compression mechanism 3 at a relatively high pressure that is greater than the relatively low-pressure suction pressure, wherein the relatively high pressure is commonly referred to as the discharge pressure of the scroll compressor 1. A passive discharge valve 120 may be employed to selectively permit a flow of the compressed fluid from the fixed scroll 5. It is understood the passive discharge valve 120 may be coupled to the fixed scroll 5 by at least one coupling element (e.g., a mechanical fastener). However, other coupling means or methods of integration may be employed such as those described herein, for example.

The orbiting scroll 7 is configured to orbit relative to the fixed scroll 5 in a manner wherein each of the compression chambers 9 progresses circumferentially and radially inwardly towards the radially central discharge port 13. A shape and position of each of the compression chambers 9 accordingly changes relative to the fixed shape and position of the fixed scroll 5 during the repeating orbiting motion of the orbiting scroll 7. This motion causes each of the compression chambers 9 to reduce in flow volume as each of the compression chambers 9 approaches the radially inwardly disposed radially central discharge port 13, thereby causing the compression of the fluid.

FIG. 3 illustrates the cross-section through the fixed scroll 5 and the orbiting scroll 7 when the compression mechanism 3 is at a position having two pairs of opposing compression chambers 9. Each of the compression chambers 9 forming one of the pairs includes substantially the same shape rotated 180 degrees relative to the other of the paired and opposing compression chambers 9. A first pair of the compression chambers 9 is disposed immediately adjacent a radial center of each of the spiral structures 6, 8 (generally corresponding to the position of the radially central discharge port 13) while a second pair of the compressions chambers 9 is formed radially outwardly of the first pair of the compression chambers 9 closer to the inlet openings 11.

Figure 4:
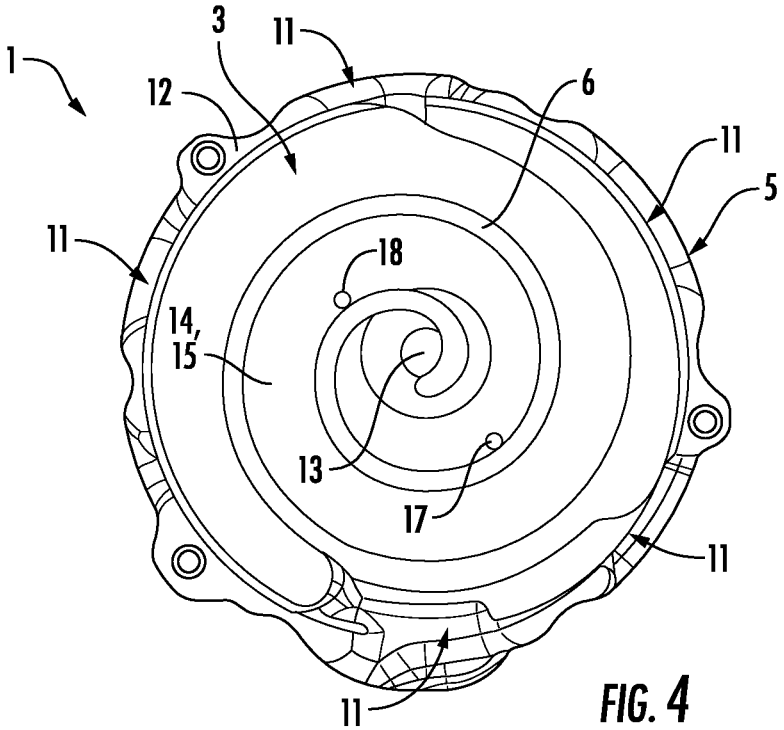
FIG. 4 is an axial front end elevational view of a fixed scroll of the compression mechanism of FIG. 3 with the fixed scroll shown in isolation.

The fixed scroll 5, shown in FIGS. 1 and 4, includes an end wall 14 including an inner face 15 and an opposing outer face 16. The inner face 15 faces towards the orbiting scroll 7 with the first spiral structure 6 extending axially from the inner face 15. The outer face 16 faces away from the orbiting scroll 7 and faces towards the passive discharge valve 120. The radially central discharge port 13 is formed through the end wall 14 from the inner face 15 to the outer face 16 thereof. FIG. 4 shows the inner face 15 of the end wall 14 with the orbiting scroll 7 omitted to better illustrate the positioning of the radially central discharge port 13 relative to the configuration of the first spiral structure 6.

Figure 2:
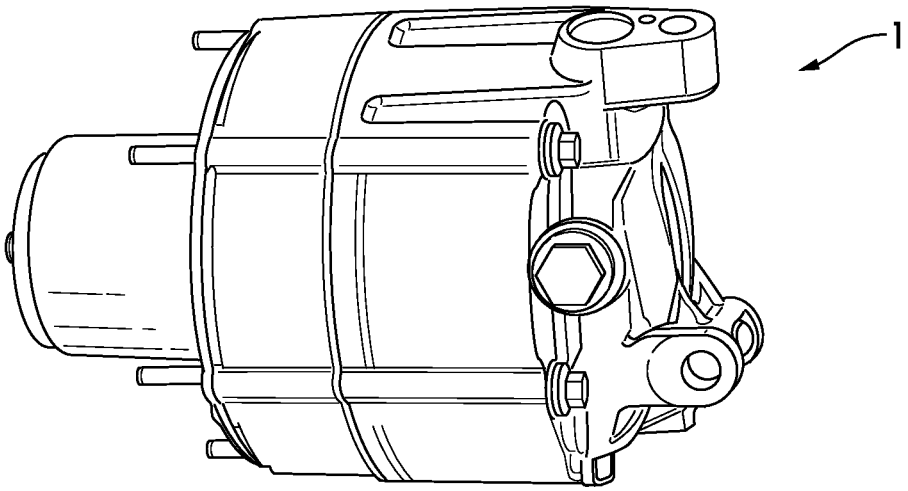
FIG. 2 is a side perspective view of a rear housing of the scroll compressor shown in FIG. 1.

A first housing portion 110 of the scroll compressor 1 is an open ended and hollow structure configured to mate with a second housing portion 112 and/or a third housing portion 116 of the scroll compressor 1 for enclosing the internal components thereof. The first housing portion 110 defines a rear head 111 configured to receive the fixed scroll 5 and the passive discharge valve 120 therein. An exemplary first housing portion 110 is shown in FIG. 2. It should be appreciated that alternative configurations of the housing components of the scroll compressor 1 may be provided so long as the relevant structures for directing the flow of the fluid are maintained as described hereinafter, including the use of additional housing components or the use of housing components having alternatively arranged joints present therebetween. More specifically, any combination of housing components may be utilized so long as the rear head 111 is provided to receive the fixed scroll 5 and the passive discharge valve 120 therein in a manner promoting operation of the passive discharge valve 120 as disclosed hereinafter.

The rear head 111 is in fluid communication with a fluid return passage 113. The fluid return passage 113 provides fluid communication between the rear head 111 and another component (not shown) of the associated fluid circuit through which the fluid is passed after being initially compressed within the compression mechanism 3 of the scroll compressor 1. For example, the component may be a separator (not shown) disposed downstream of the compression mechanism 3 and upstream of a low pressure side of the scroll compressor 1 with respect to a general direction of flow of the fluid through the fluid circuit, such as a cyclone separator.

Figure 5A:
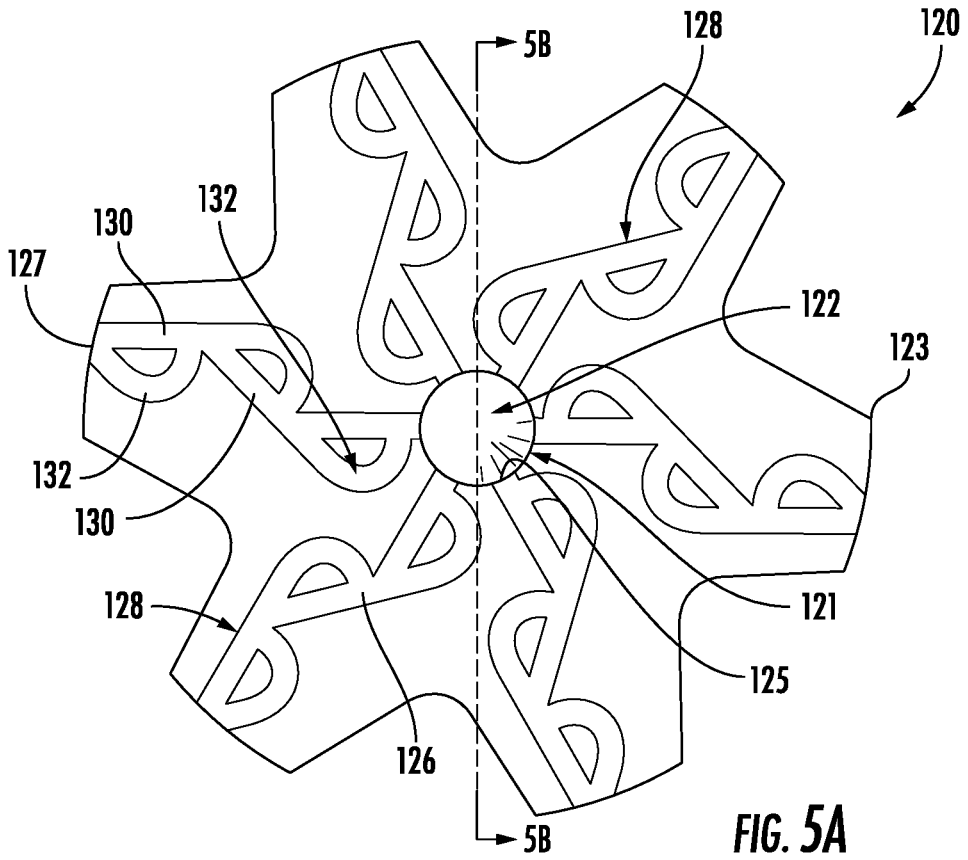
FIG. 5A is an axial front end elevational view of a passive discharge valve according to an embodiment of the present disclosure.
Figure 5B:
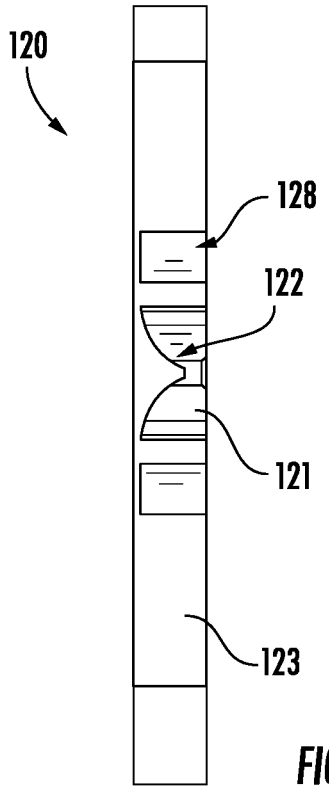
FIG. 5B is an cross-sectional view of the passive discharge valve taken along section line 5B-5B which is shown in FIG. 5A.

FIGS. 5A-6D illustrate an exemplary embodiment of the passive discharge valve 120. FIG. 5A depicts a main body 123 having a common central location 121 located at a center of the passive discharge valve 120, and includes a flow feature 122 that is designed to direct the flow of the fluid into one or more valvular conduits 128. In some instances, the flow feature 122 may be in the shape of a concave or curved cone. It is understood, however, that the flow feature 122 may have any suitable shape, size, and configuration as desired. Inlet and outlet apertures 125, 127, respectively, provided as an opening, indentation, or other form of passageway, allow for the fluid to enter and exit the one or more valvular conduits 128. As depicted in FIGS. 5B and 6B, a cross-sectional shape of the apertures 125, 127, and/or valvular conduits 128 may be generally rectangular, but a geometry of the apertures 125, 127 and/or the valvular conduits 128 should not be limited to rectangles and may be any geometry as packaging, function, and performance of the scroll compressor 1 and/or the valvular conduits 28 requires.

Figure 6A:
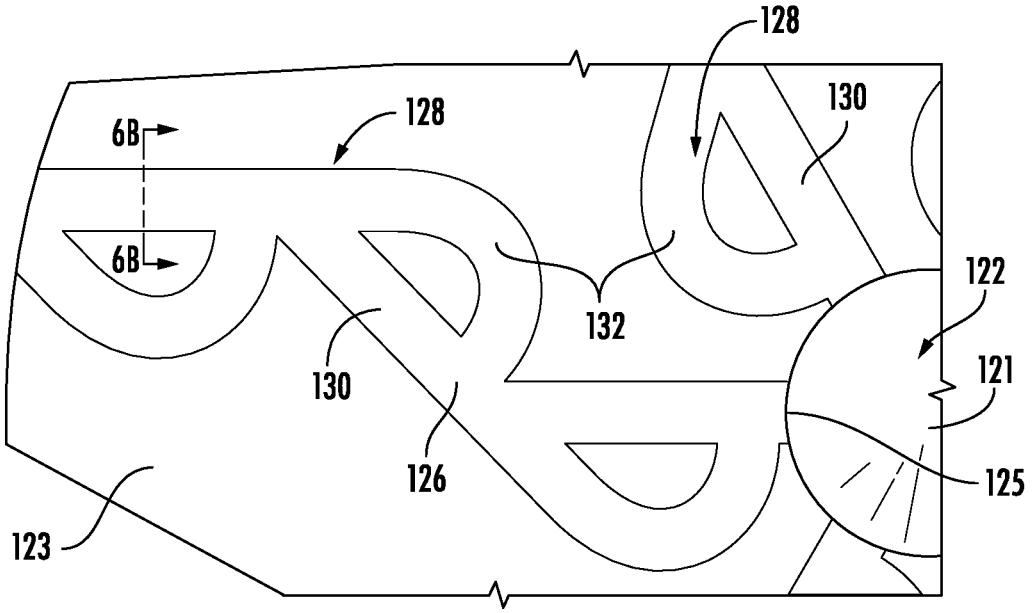
FIG. 6A is an enlarged, fragmentary view of the passive discharge valve of FIGS. 5A and 5B, showing valvular conduits forming fluidic diodes.
Figure 6B:
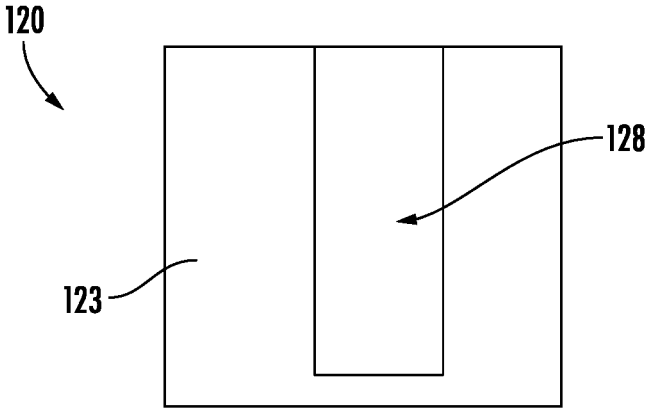
FIG. 6B is an enlarged cross-sectional view, taken along section line 6B-6B of FIG. 6A, of the valvular conduits of the passive discharge valve of FIGS. 5A and 5B.

The one or more valvular conduits 128, formed by recesses and protrusions in the main body 123 originate from the common central location 121 of the passive discharge valve 120 and extend radially outwardly therefrom, creating a radial array of valvular conduits 128. The one or more valvular conduits 128 comprise one or more fluidic valves or diodes 126 formed by creating a first flow path 130 that is intersected by a second flow path 132 at one or more locations along the valvular conduit 128 between the inlet and outlet apertures 125, 127. The fluidic diodes 126 have a specific pattern that allow for unimpeded flow in a first direction (shown by straight solid arrows 150 in FIG. 6C) while impeding flow in a second direction (shown by straight solid arrows 152 in FIG. 6D) by directing a portion of a reverse fluid flow (or back flow) through the second flow path 132 (shown by curved dashed arrows 154 in FIG. 6D), thus preventing backflow of the fluid through the valvular conduits 128 from occurring. This generally linked and looped pattern is best illustrated in FIGS. 6A, 6C, and 6D, where the two separate paths 130, 132 are depicted forming one valvular conduit 128, originating from the common central location 121 where the fluid enters the passive discharge valve 120.

Figure 6C:
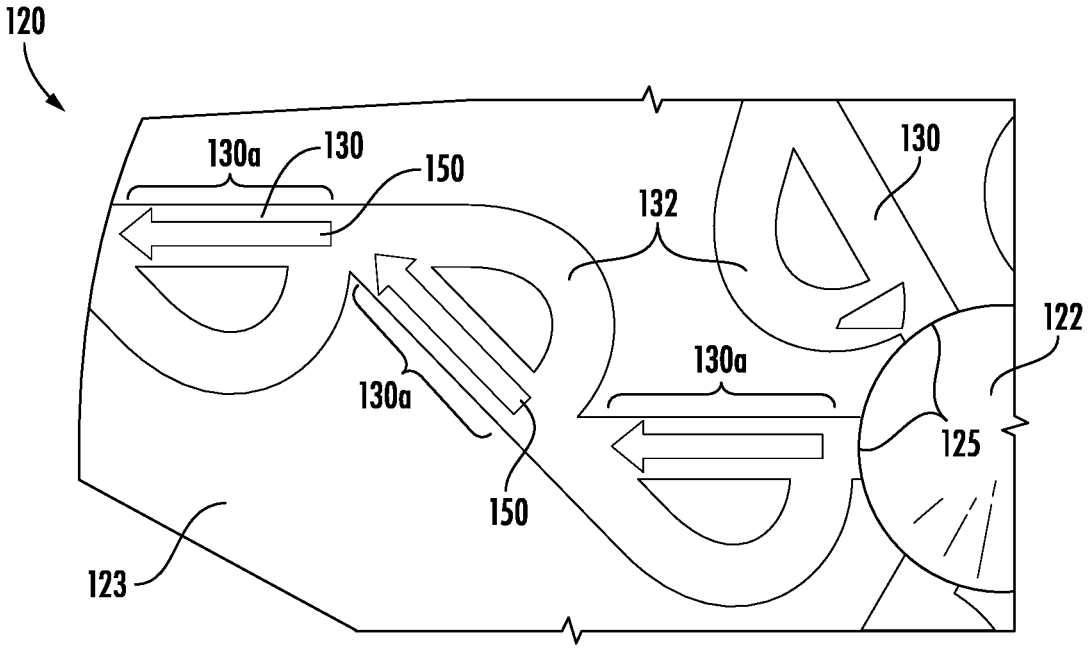
FIG. 6C is an enlarged, fragmentary view of the passive discharge valve of FIGS. 5A and 5B, wherein arrows show an unimpeded outward flow of the fluid through the valvular conduits forming the fluidic diodes of the passive discharge valve.
Figure 6D:
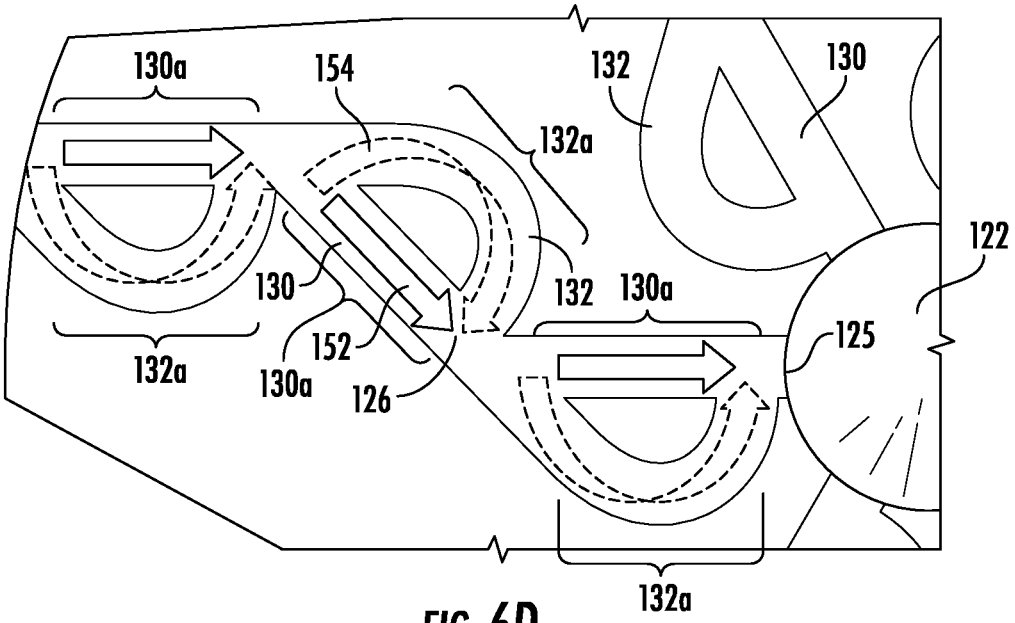
FIG. 6D is an enlarged, fragmentary view of the passive discharge valve of FIGS. 5A and 5B, wherein arrows show an unimpeded inward flow of the fluid through the valvular conduits forming fluidic diodes of the multipath passive discharge valve.

FIGS. 6C and 6D illustrate the first and second flow paths 130, 132 and the flow pattern created by each fluidic diode 126. The first flow path 130, as depicted best in FIG. 6C, may be compromised of a plurality of linear first segments 130*a*. The first segments 130*a* may be fluidly connected together at slight angles to promote the flow of the fluid in the first direction from the inlet aperture 125 to the outlet aperture 127. The second flow path 132, as best shown in FIG. 6D, may be comprised of a plurality of arcuate shaped second segments 132*a* that intersect the first segments 130*a* intermittently at an angle. In certain embodiments, the second flow path 132 intersects the first flow path 130 at an angle between about 0 and 180 degrees, preferably, at about 90 degrees. The intersection of the two paths 130, 132 creates the fluidic diodes 126, which cause pressure losses that militate against the reverse flow of the fluid from occurring in the valvular conduit 128.

Each of the valvular conduit 128 may include a plurality of the fluidic diodes 126. FIG. 6C illustrates the outward flow of the fluid from the inlet aperture 125 at the common central location 121 to the outlet aperture 127. The outlet aperture 127 may be in fluid communication with a discharge chamber 115 contained in the rear head 111 of the scroll compressor 1. When the fluid flows in the first direction, the fluid mainly follows the first segments 130*a* of the first flow path 130, and flows uninterrupted and unimpeded from the inlet apertures 125 at the common central location 121 the valvular conduits 128 to the outlet apertures 127 of the passive discharge valve 120. FIG. 6D illustrates the inward flow of the fluid from the outlet apertures 127 through the valvular conduits 128 of the passive discharge valve 120 to the inlet apertures 125 at the common central location 121. When the fluid flows in the second direction, the fluid may flow through both the first and second segments 130*a*, 132*a*. The fluid passing through the second segments 132*a* in the second direction interrupts the fluid flowing through the first segments 130*a* in the second direction, thereby militating against the reverse fluid flow or backflow that may cause pressure pulsation during the operation of the scroll compressor 1.

Figure 7:
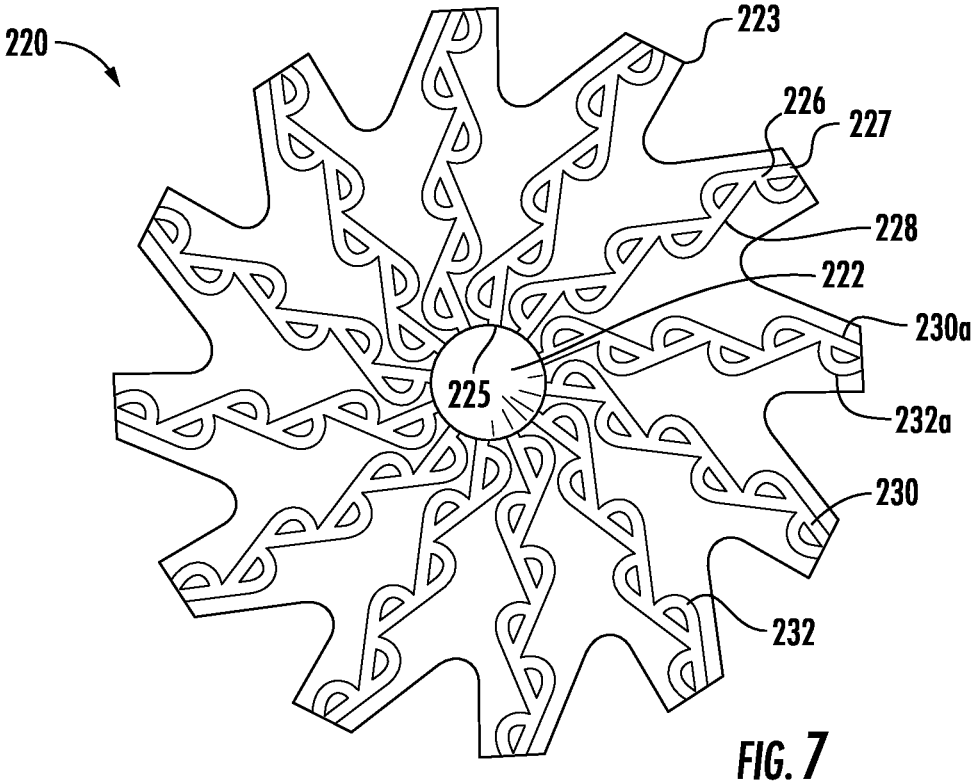
FIG. 7 is an axial front end view of a passive discharge valve according to another embodiment of the present disclosure.

FIG. 7 illustrates a passive discharge valve 220, according to another exemplary embodiment of the present disclosure, having substantially similar or the same structure as the passive discharge valve 120 identified by 200 series reference numerals. The passive discharge valve 220 has additional valvular conduits 228 as compared to the number of valvular conduits 128 of the passive discharge valve 120. The passive discharge valve 220 may further include a flow feature 222 that is designed to direct the flow of the fluid into one or more of the valvular conduits 228. The one or more valvular conduits 228 comprise one or more fluidic valves or diodes 226 formed by creating a first flow path 230 that is intersected by a second flow path 232 at one or more locations along the valvular conduit 228 between the inlet and outlet apertures 225, 227. The first flow path 230 may be compromised of a plurality of linear first segments 230*a*. The first segments 230*a* may be fluidly connected together at slight angles to promote the flow of the fluid in the first direction from the inlet aperture 225 to the outlet aperture 227. The second flow path 232 may be comprised of a plurality of arcuate shaped second segments 232*a* that intersect the first segments 230*a* intermittently at an angle. In certain embodiments, the second flow path 232 intersects the first flow path 230 at an angle between about 0 and 180 degrees, preferably, at about 90 degrees. The intersection of the two paths 230, 232 creates the fluidic diodes 226, which cause pressure losses that militate against the reverse flow of the fluid from occurring in the valvular conduit 228.

Figure 8:
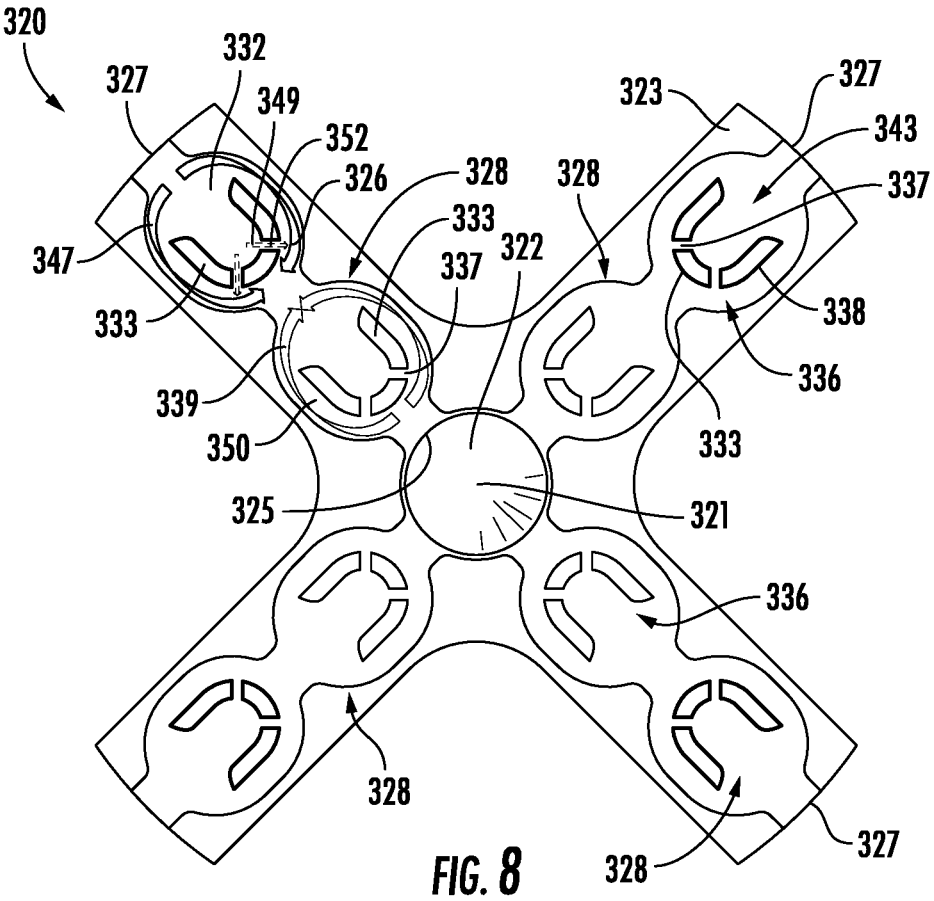
FIG. 8 is an axial front end view of a passive discharge valve according to yet another embodiment of the present disclosure.

FIG. 8 illustrates a passive discharge valve 320 in accordance with another embodiment of the present disclosure. The valvular conduits 328 of the passive discharge valve 320 are formed by recesses 332 and protrusions 333 provided in the main body 323. Each of the valvular conduits 328 originate from a common central location 321 and create a radial array of valvular conduits 328. In particular embodiments, the valvular conduits 328 may be formed by recesses 332 and protrusions 333 creating a U-shaped profile 336. In certain instances, one or more gaps 337 may be formed between the protrusions 333 of the U-shaped profile 336 to allow for unrestricted and uninterrupted flow in a first direction, and interrupted or impeded flow in a second direction. The passive discharge valve 320 may further include a flow feature 322 that is designed to direct the flow of the fluid into one or more of the valvular conduits 328.

First and second flow paths 350, 352 are formed by the U-shaped profile 336. An outward flow of the fluid in a first direction may be defined as flow from an inlet aperture 325 at the common central location 321 to an outlet aperture 327, which is in fluid communication with the discharge chamber 115 contained in the rear head 111 of the scroll compressor 1. When flowing outward, as indicated by solid arrows 339 in FIG. 8, the fluid flows around a trough of the U-shaped profile 336 of the valvular conduits 328, creating fluid movement that is uninterrupted and unimpeded through the first flow path 350. FIG. 8 also illustrates an inward flow of the fluid in a second direction from the outlet aperture 327 through the recesses 332 of the passive discharge valve 320 to the common central location 321. When flowing inward, as indicated by solid arrows 347 and dashed arrows 349 in FIG. 8, the fluid both flows around an open end 343 of the U-shaped profile 336 of the valvular conduits 328 and through the gaps 337. The gaps 337 permit the flow of the fluid through the second flow path 352 in the second direction to intersect a reverse fluid flow (or backflow) through the first flow path 350 in the second direction which creates at least one fluidic diode 326, and thus prevents backflow of the fluid through the valvular conduits 328 (which may cause pressure pulsation during operation of the scroll compressor 1) from occurring.

Figure 9A:
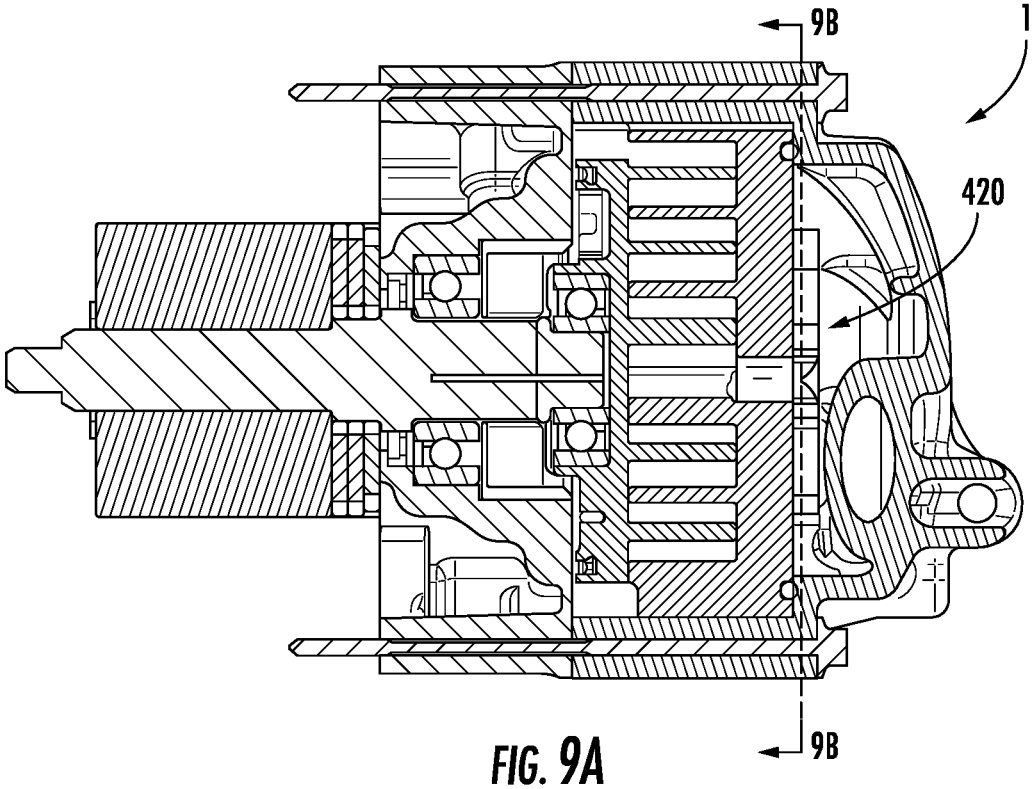
FIG. 9A is a cross-sectional view of a portion of the scroll compressor of FIG. 1 according to an embodiment of the present disclosure, wherein the passive discharge valve in is directly coupled to the fixed scroll.
Figure 9B:
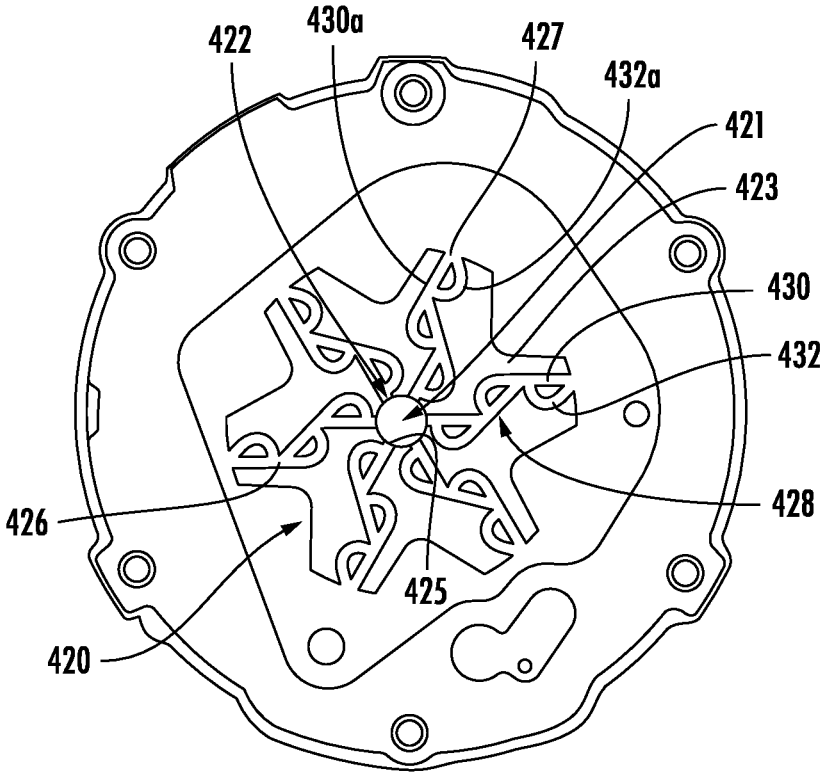
FIG. 9B is a cross-sectional view of the scroll compressor taken along section line 9B-9B of FIG. 9A.
Figure 9C:
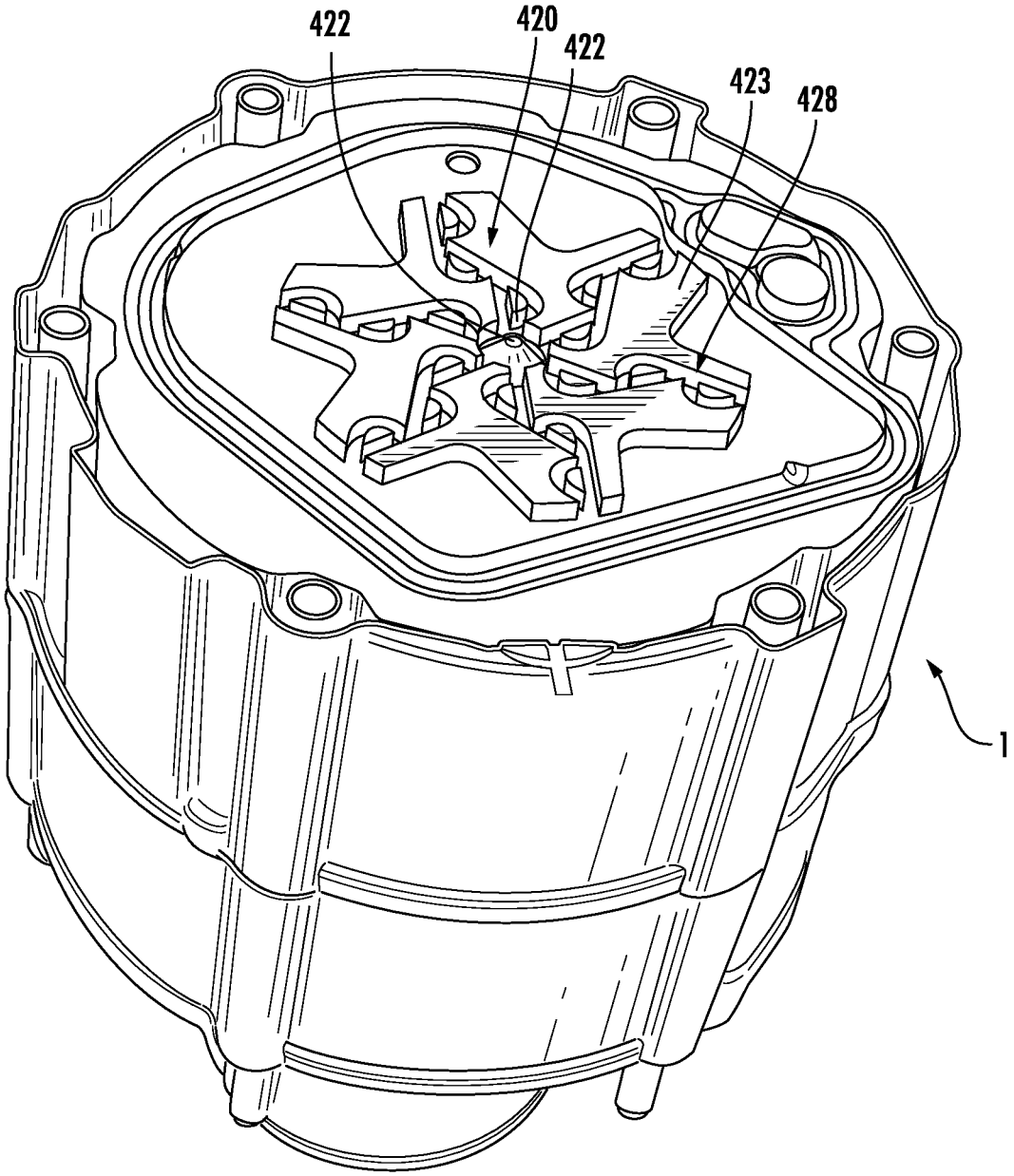
FIG. 9C is a perspective sectional view of the scroll compressor of FIGS. 9A and 9B.

FIGS. 9A, 9B, and 9C illustrate one of the exemplary embodiments of integration of the passive discharge valve 420 into the scroll compressor 1. Substantially similar or the same structure of the passive discharge valve 420 as that of the passive discharge valves 120 and 220 is identified by 400 series reference numerals. In this embodiment, the passive discharge valve 420 is manufactured and machined as a separate component from the scroll compressor 1. The passive discharge valve 420 may be affixed to the scroll compressor 1 in any suitable manner, more preferably by a coupling member (not depicted). In some instances, the passive discharge valve 420 may be coupled to the fixed scroll 5 by a mechanical fastener, such as, but not limited to, a screw or a bolt. One or more gaskets (not depicted) may be disposed in between the passive discharge valve 420 and the fixed scroll 5 to form a substantially fluid tight seal therebetween. The passive discharge valve 420 may be formed of any suitable material, preferably metal.

The one or more valvular conduits 428, formed by recesses and protrusions, may be formed in the main body 423 originate from the common central location 421 of the passive discharge valve 420 and extend radially outwardly therefrom, creating a radial array of valvular conduits 428. It is understood that the one or more valvular conduits 428 may be formed by any suitable forming process such as a subtractive forming process (e.g., a cutting or machining process) and an additive forming process (e.g., a three-dimension printing process), for example. The passive discharge valve 420 may further include a flow feature 422 that is designed to direct the flow of the fluid into one or more of the valvular conduits 428. The one or more valvular conduits 428 comprise one or more fluidic valves or diodes 426 formed by creating a first flow path 430 that is intersected by a second flow path 432 at one or more locations along the valvular conduit 428 between the inlet and outlet apertures 425, 427. The first flow path 430 may be compromised of a plurality of linear first segments 430*a*. The first segments 430*a* may be fluidly connected together at slight angles to promote the flow of the fluid in the first direction from the inlet aperture 425 to the outlet aperture 427. The second flow path 432 may be comprised of a plurality of arcuate shaped second segments 432*a* that intersect the first segments 430*a* intermittently at an angle. In certain embodiments, the second flow path 432 intersects the first flow path 430 at an angle between about 0 and 180 degrees, preferably, at about 90 degrees. The intersection of the two paths 430, 432 creates the fluidic diodes 426, which cause pressure losses that militate against the reverse flow of the fluid from occurring in the valvular conduit 428. The fluidic diodes 426 have a specific pattern that allow for unimpeded flow in a first direction while impeding flow in a second direction by directing a portion of a reverse fluid flow (or back flow) through the second flow path 432, thus preventing backflow of the fluid through the valvular conduits 428 from occurring. This generally linked and looped pattern is best illustrated in FIG. 9B, where the two separate paths 430, 432 are depicted forming one valvular conduit 428, originating from the common central location 421 where the fluid enters the passive discharge valve 420. A structure and operation of the valvular conduits 428 is substantially similar to the structure and operation of the valvular conduits 128, 228, 328 and for simplicity purposes is not repeated herein.

FIG. 10 illustrates another embodiment of the integration of the passive discharge valve 520 into the scroll compressor 1. A structure and operation of the passive discharge valve 520 are substantially similar to the structure and operation of the passive discharge valves 120, 220, 320, and 420 but identified with a 500 series reference number, and for simplicity purposes is not repeated herein. In this embodiment, however, the passive discharge valve 520 may be integrated by integrally forming the passive discharge valve 520 into the rear head 111 of the scroll compressor 1. It is understood that the passive discharge valve 520 may be formed into the rear head 111 by any suitable means or method as desired such as by a machining process, for example. Additionally, a flow feature (not depicted) may be formed into the rear head 111 of the scroll compressor 1. The flow feature may be comprised of any suitable material, preferably metal, and may have a slightly smaller diameter than the radially central discharge port 13. One or more gaskets (not depicted) may be placed in between the fixed scroll 5 and the passive discharge valve 520 formed in the rear head 111 of the scroll compressor 1 to form a substantially fluid-tight seal therebetween.

The passive discharge valve 520 may include one or more valvular conduits 528, formed by recesses and protrusions in the main body 523, which originate from a common central location 521 of the passive discharge valve 520 and extend radially outwardly therefrom. The valvular conduits 528 comprise one or more fluidic valves or diodes 526 formed by creating a first flow path 530 that is intersected by a second flow path 532 at one or more locations along the valvular conduit 528 between the inlet and outlet apertures 525, 527. In certain embodiments, the second flow path 532 intersects the first flow path 530 at an angle between about 0 and 180 degrees, preferably, at about 90 degrees. The intersection of the two paths 530, 532 creates the fluidic diodes 526, which cause pressure losses that militate against the reverse flow of the fluid from occurring in the valvular conduit 528. The fluidic diodes 526 have a specific pattern that allow for unimpeded flow in a first direction while impeding flow in a second direction by directing a portion of a reverse fluid flow (or back flow) through the second flow path 532, thus preventing backflow of the fluid through the valvular conduits 528 from occurring. This generally linked and looped pattern is best illustrated where the two separate paths 530, 532 are depicted forming one valvular conduit 528, originating from the common central location 521 where the fluid enters the passive discharge valve 520. A structure and operation of the valvular conduits 528 is substantially similar to the structure and operation of the valvular conduits 128, 228, 328, 428 and for simplicity purposes is not repeated herein.

FIG. 11 illustrates another embodiment of the integration of the passive discharge valve 620 into the scroll compressor 1. A structure and operation of the passive discharge valve 620 are substantially similar to the structure and operation of the passive discharge valves 120, 220, 320, 420, and 520 but identified with a 600 series reference number, and for simplicity purposes is not repeated herein. In this embodiment, however, the passive discharge valve 620 may be integrated by integrally forming the passive discharge valve 620 into the fixed scroll 5 of the compression mechanism 3 of the scroll compressor 1. It is understood that the passive discharge valve 620 may be formed into the fixed scroll 5 by any suitable means or method as desired such as by a machining process, for example. Additionally, the flow feature 622 may be formed into the fixed scroll 5 of the scroll compressor 1. The flow feature 622 may be comprised of any suitable material, preferably metal, and may have a slightly smaller diameter than the discharge port 13. One or more gaskets (not depicted) may be placed in between the passive discharge valve 620 formed in the fixed scroll 5 and the rear head 111 of the scroll compressor 1 to form a substantially fluid-tight seal therebetween.

The passive discharge valve 620 may include one or more valvular conduits 628, formed by recesses and protrusions in the main body 623, which originate from a common central location 621 of the passive discharge valve 620 and extend radially outwardly therefrom. The valvular conduits 628 comprise one or more fluidic valves or diodes 626 formed by creating a first flow path 630 that is intersected by a second flow path 632 at one or more locations along the valvular conduit 628 between the inlet and outlet apertures 625, 627. In certain embodiments, the second flow path 632 intersects the first flow path 630 at an angle between about 0 and 180 degrees, preferably, at about 90 degrees. The intersection of the two paths 630, 632 creates the fluidic diodes 626, which cause pressure losses that militate against the reverse flow of the fluid from occurring in the valvular conduit 628. The fluidic diodes 626 have a specific pattern that allow for unimpeded flow in a first direction while impeding flow in a second direction by directing a portion of a reverse fluid flow (or back flow) through the second flow path 632, thus preventing backflow of the fluid through the valvular conduits 628 from occurring. This generally linked and looped pattern is best illustrated where the two separate paths 630, 632 are depicted forming one valvular conduit 628, originating from the common central location 621 where the fluid enters the passive discharge valve 620. A structure and operation of the valvular conduits 628 is substantially similar to the structure and operation of the valvular conduits 128, 228, 328, 428, 528 and for simplicity purposes is not repeated herein.

It should be appreciated that the number of the valvular conduits 128, 228, 328, 428, 528, 628 can be increased or decreased based on compressor mass flow requirements. Increasing the number of the valvular conduits 128, 228, 328, 428, 528, 628 can increase total mass flow. Exterior shape of the passive discharge valves 120, 220, 320, 420, 520, 620 has no effect on design performance. Preferred embodiments include a multitude of radial valvular conduits 128, 228, 328, 428, 528, 628 originating from the common central location 121, 221, 321, 421, 521, 621. Each of the valvular conduits 128, 228, 328, 428, 528, 628 contains multiple fluidic diodes 126, 226, 326, 426, 526, 626 that allow low-loss fluid passage in one direction, while preventing fluid from passing in the reverse direction (or backflow). The fluidic diodes 126, 226, 326, 426, 526, 626 are formed by creating second fluid paths 132, 232, 352, 432, 532, 632 that intermittently intersect first fluid paths 130, 230, 350, 430, 530, 630 during a reverse flow condition, thereby creating regions of high-loss preventing fluid cross flow.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

The invention claimed is:

1. A a scroll compressor having a passive discharge valve, the passive discharge valve comprising:

a plurality of valvular conduits each having an inlet aperture in fluid communication with a radially central discharge port of a compression mechanism of the scroll compressor and an outlet aperture in fluid communication with a discharge chamber of the scroll compressor, wherein the valvular conduits each comprise a first flow path and a second flow path, wherein the second flow path intermittently intersects the first flow path to create at least one fluidic diode in the valvular conduits.

2. The passive discharge valve according to claim 1, wherein the inlet aperture is in fluid communication with a discharge port of the compression mechanism.

3. The passive discharge valve according to claim 1, wherein the first flow path comprises a plurality of linear segments.

4. The passive discharge valve according to claim 1, wherein the second flow path comprises a plurality of arcuate shaped second segments.

5. The passive discharge valve according to claim 1, wherein the first flow path is configured to permit a flow of a fluid from the compression mechanism to the discharge chamber in a first direction.

6. The passive discharge valve according to claim 5, wherein the second flow path is configured to militate against a flow of the fluid from the discharge chamber to the compression mechanism in a second direction.

7. The passive discharge valve according to claim 1, the at least one fluidic diode militates against a flow of a fluid from the discharge chamber to the compression mechanism.

8. The passive discharge valve according to claim 1, wherein the second flow path intersects the first flow path at an angle in a range of about 0 degrees to about 180 degrees.

9. The passive discharge valve according to claim 1, wherein the second flow path intersects the first flow path at an angle of about 90 degrees.

10. The passive discharge valve according to claim 1, wherein at least one of the inlet aperture, the outlet aperture, and a portion of the valvular conduits between the inlet and outlet apertures has a generally rectangular cross-sectional shape.

11. The passive discharge valve according to claim 1, wherein the passive discharge valve is a separate component coupled to at least one of the compression mechanism and a housing of the scroll compressor.

12. The passive discharge valve according to claim 1, wherein the valvular conduits isare formed in a main body of the passive discharge valve.

13. The passive discharge valve according to claim 1, wherein the passive discharge valve is integrally formed with at least one of the compression mechanism and a housing of the scroll compressor.

14. The passive discharge valve according to claim 1, wherein the valvular conduits are formed in at least one of a fixed scroll of the compression mechanism and a rear head of the scroll compressor.

15. The passive discharge valve according to claim 1, wherein the valvular conduits are formed by a plurality of protrusions defining a U-shaped profile.

16. The passive discharge valve according to claim 15, wherein at least one gap is formed between the protrusions to define at least one of the first flow path and the second flow path.

17. The passive discharge valve according to claim 1, wherein the valvular conduits extend radially outwardly from a common central location of the passive discharge valve.

18. The passive discharge valve according to claim 1, further comprising a flow feature configured to direct a flow of a fluid from the compression mechanism into the valvular conduits.

19. The passive discharge valve according to claim 18, wherein the flow feature has a generally curved cone shape.

20. A method for controlling fluid flow in a scroll compressor, comprising:

providing a passive discharge valve in fluid communication with a compression mechanism of the scroll compressor and a discharge chamber of the scroll compressor, wherein the passive discharge valve comprises:

a plurality of valvular conduits each having an inlet aperture in fluid communication with a radially central discharge port of the compression mechanism and each of the valvular conduits including a first flow path and a second flow path, wherein the second flow path intermittently intersects the first flow path to create at least one fluidic diode in the valvular conduits to militate against a flow of a fluid from the discharge chamber to the compression mechanism.

* * * * *